US005598786A

United States Patent [19]

Patterson

[11] Patent Number: 5,598,786

[45] Date of Patent: Feb. 4, 1997

[54] LAPTOP DESK

[76] Inventor: Lawrence W. Patterson, 251 S. Quintana Dr., Anaheim, Calif. 92807

[21] Appl. No.: 374,230

[22] Filed: Jan. 18, 1995

[51] Int. Cl.[6] ..... A47B 9/00; A47B 23/00

[52] U.S. Cl. ..... 108/43; 248/188.2

[58] Field of Search ..... 108/43, 6; 248/455, 248/188.2, 465, 457

[56] References Cited

U.S. PATENT DOCUMENTS

| | | | |
|---|---|---|---|
| 89,146 | 4/1869 | Hatch . | |
| 1,308,034 | 7/1919 | Bonnifield . | |
| 1,598,569 | 8/1926 | Fitzhugh . | |
| 2,003,241 | 5/1935 | Brown . | |
| 2,547,642 | 4/1951 | Heuser . | |
| 2,844,429 | 7/1958 | Frey | 108/43 |
| 3,123,935 | 3/1964 | Williams . | |
| 3,220,025 | 11/1965 | Nelson . | |
| 3,276,045 | 10/1966 | Bement . | |
| 4,017,920 | 4/1977 | Sieg . | |
| 4,108,083 | 8/1978 | Espinosa . | |
| 4,116,413 | 9/1978 | Andersen | 248/455 X |
| 4,123,852 | 11/1978 | Zimowski . | |
| 4,848,243 | 7/1989 | Giordano | 248/455 X |
| 4,926,758 | 5/1990 | Lilly et al. . | |
| 4,940,003 | 7/1990 | Mayhew et al. . | |
| 4,976,204 | 12/1990 | Konkle . | |
| 4,978,096 | 12/1990 | Struckmann | 248/455 X |
| 5,081,936 | 1/1992 | Drieling . | |
| 5,127,339 | 7/1992 | Hood, Jr. . | |
| 5,176,274 | 1/1993 | Jenkins . | |

*Primary Examiner*—Peter M. Cuomo
*Assistant Examiner*—Anthony D. Barfield
*Attorney, Agent, or Firm*—Fulwider Patton Lee & Utecht, LLP

[57] ABSTRACT

A portable laptop table which is readily selectively adjustable in the height of the table over the user's lap.

4 Claims, 2 Drawing Sheets

FIG. 1
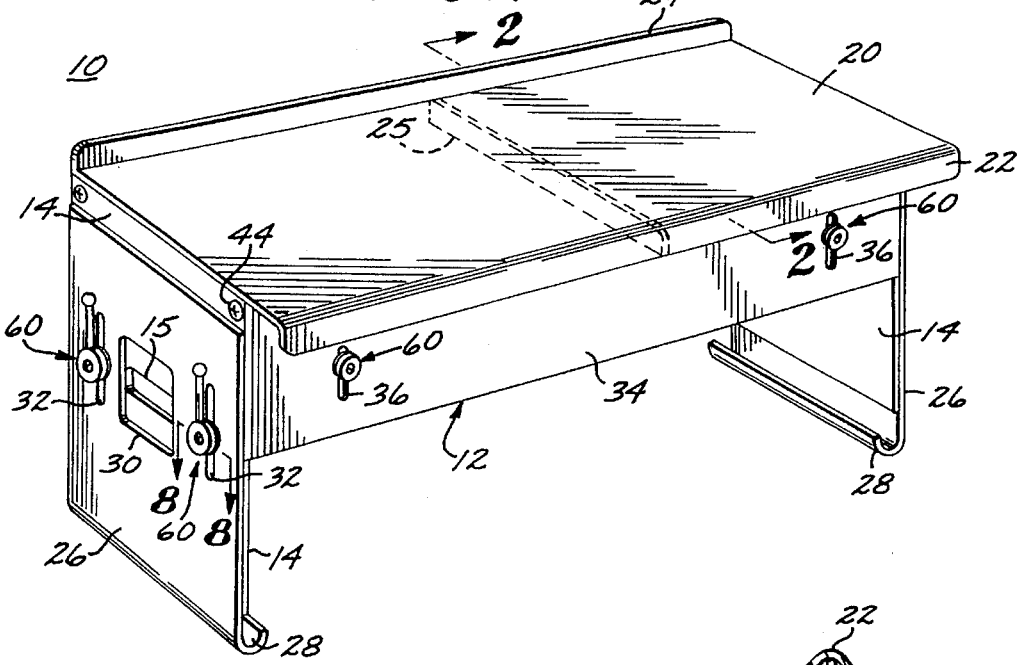
FIG. 3
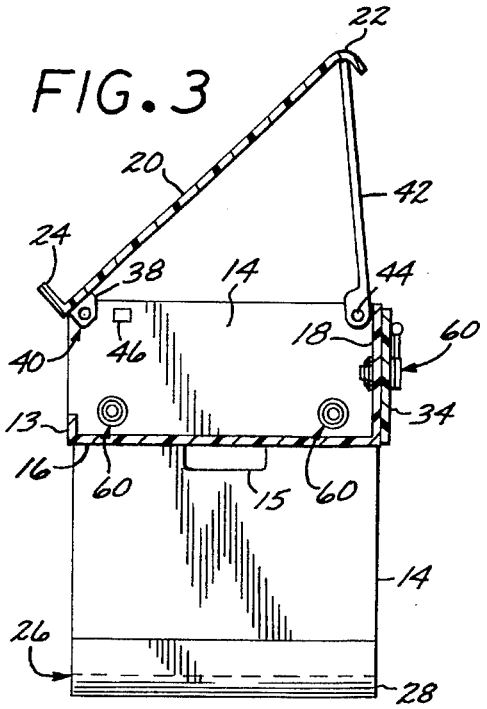
FIG. 2
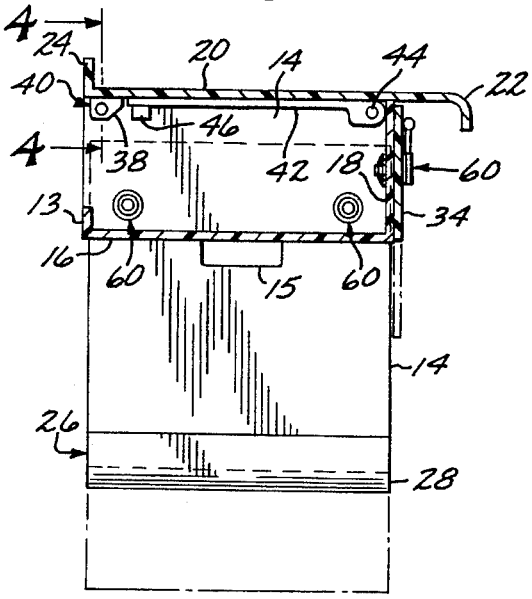
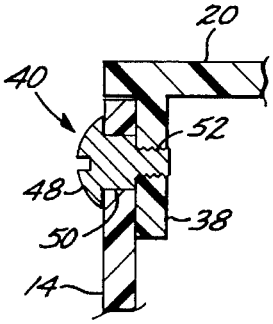
FIG. 4

LAPTOP DESK

BACKGROUND OF THE INVENTION

This invention relates generally to a device for supporting articles and, more particularly, to a portable laptop device having an adjustable article support surface.

Laptop article support devices, of course, are well known in the art. Typically, these devices are constructed as tables having a pair of laterally spaced apart legs or stands which straddle the user and on which a horizontally disposed table surface is placed across and secured thereto.

Some of these laptop table devices are provided with adjustment means which allow for vertical height adjustment of the table surface over the user's lap. Other tables allow for adjustment of the inclination of the table surface relative to the table legs. Having the table surface adjustable to a rearward inclination allows for books and/or other reading materials to be supported thereon and positioned at a comfortable reading position.

Such laptop table devices are frequently used in hospitals and nursing care homes. These tables are typically used for supporting tableware, dining utensils, and reading or writing materials and the like. Because the elderly, handicapped, and infirm utilize this type of laptop table and may otherwise lack manual dexterity, it is desirable that the table surface adjustment means be easy to access, easy to operate without undue effort, and when such table surface is adjusted, provide secure locking engagement thereof relative to the table legs. It is also desirable that the adjustment means be operable without the use of tools.

Others have incorporated support surface vertical height adjustment means in portable laptop article support devices. Typically, the adjustment means used in these devices have been comprised of a plurality of equally spaced apart recesses or openings interspaced along the extent of extendable height adjustable legs. A pin or a catch was provided and adapted to engage one of the selected openings to lock the extendable legs at an adjusted position. Although this type of adjustment means proved effective in use, the resolution of adjustability of the height adjustment means was restricted to the breadth of inter-spacing between the recesses or openings.

Due to the many anatomical characteristics of laptop table users, it is desirable to have a high resolution height adjustment means which may be finely adjusted to comfortably accommodate many different users and the many positions such users may orientate themselves, be it sitting upright, lying back, or the like.

A portable laptop article support device of this nature should also be usable in a variety of environments. For instance, the laptop device should be narrow enough to fit between the arms of wheel chairs and small enough for use in automobiles.

Hence, it had been found desirable to those skilled in the art to provide a portable laptop article support device having an easily operable high resolution adjustment means to comfortably fit the article support surface over the user's lap. It is also desirable for such a device to include a support surface tilting feature for adjusting the surface to an inclination for supporting reading materials in a comfortable position. In addition, such a laptop device should include a tray for storing writing implements, and papers. Above all, the device should be lightweight, relatively inexpensive to manufacture, easy to construct, and reliable in use. The device of the invention meets the needs and others.

SUMMARY OF THE INVENTION

The invention is directed to a portable laptop desk having an article support surface that may be tilted rearwardly relative to the desk and including an adjustment means for adjusting the height of the desk over the user's lap. Briefly, and in general terms, the laptop desk includes a frame having a pair of side members, a pair of support legs adjustably mounted to the side members, and the article support surface.

The article support surface is pivotally mounted to the frame so that such surface may lie on the frame in a generally horizontal position. At the option of the user, the support surface may be titled upwardly and held relative to the frame so that reading materials or the like can be supported at a convenient viewing inclination.

In a more particular aspect of the invention, each of the side members may mount at least one respective adjustment clamp for adjusting the height of the laptop desk over the user. In this aspect, the clamp includes a guide pin, and each of the support legs include respective adjustment slots which slidably receive the respective guide pins therein. The adjustment clamps may be selectively actuated with minimal effort to hold the legs relative to the frame and side members so that the height of the laptop desk may be selectively adjusted. Because the guide pins of the adjustment clamps are disposed in a slot, the resolution of adjustment is infinite over the extent of the slot.

In another aspect of the invention, a front thigh support panel is adjustably attached to the front of the frame so that the thigh panel may be adjusted to rest on a user's thighs for providing stability to the laptop desk.

In one aspect of the invention, the frame and side members are constructed to provide a tray having open rearward access thereto for conveniently storing articles therein.

Other features and advantages of the invention will become apparent from the following detailed description, taken in conjunction with the accompanying drawings, which illustrate by way of example, the features of the invention.

BRIEF DESCRIPTION OF THE DRAWINGS

FIG. 1 is a perspective view of the portable laptop desk of the invention;

FIG. 2 is a partial sectional side view of the laptop desk taken along line 2—2 of FIG. 1;

FIG. 3 is a partial sectional side view of the laptop desk similar to that shown in FIG. 2 illustrating the article support surface thereof in an inclined position;

FIG. 4 is an enlarged sectional side view of a pivot of the article support surface taken along line 4—4 of FIG. 2;

DETAILED DESCRIPTION OF THE PREFERRED EMBODIMENT

Figure 5:
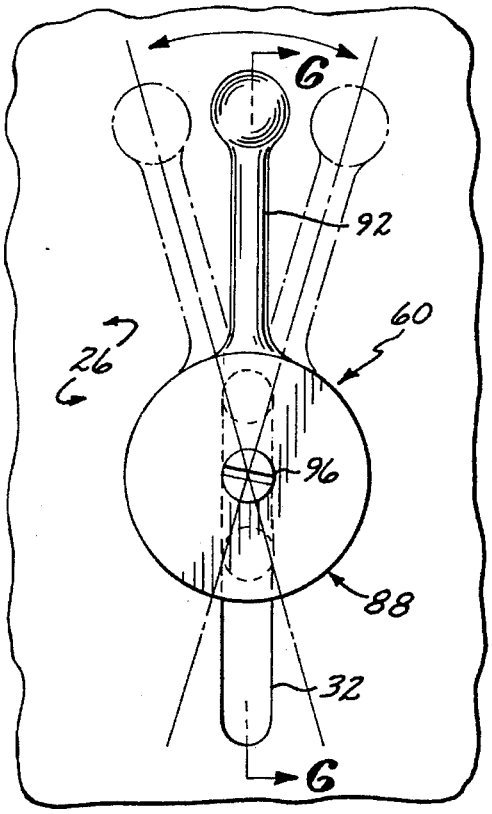
FIG. 5 is an enlarged front view of a tightening member of an adjustment clamp for use with the portable laptop desk of the invention.

As shown in the drawings for purposes of illustration, the invention is embodied in a portable laptop desk 10 having an open frame or tray 12, an article support surface 20 hingedly attached thereto, a pair of laterally spaced apart leg panels 26 carrying the tray thereon, and a plurality of adjustment locking devices 60 for locking the leg panels in a selected adjusted position relative to the frame.

Referring to FIGS. 1–4, the open tray 12 includes a rectangular bottom panel 16 fixedly secured to an upstanding front panel 18. Fixedly secured to the front panel and bottom panel on the lateral opposite ends thereof are a pair of upstanding rectangular side panels 14, the respective bottom portions thereof extending downwardly below the bottom panel. The top edges of the side panels are fixed at the same height as the top edge of the front panel. Formed in each of the respective side panels, and below the bottom panel, are respective side panel hand holes 15. The rear edge of the bottom panel 16 includes an upstanding tray lip 13 fixedly secured along the lateral extent thereof (FIGS. 2 and 3). The tray lip projects upwardly far enough to hold writing implements, dining utensils, and papers and the like within the tray, while providing convenient open rearward access thereto.

Adjustably mounted from each of the respective side panels 14 are a pair of respective rectangular desk legs or leg panels 26 of substantially the same width as the side panels. The upper portion of each respective leg panel is formed with a pair of spaced apart vertical height adjustment slots 32 through which each of the respective leg panels are adjustably secured by a pair of adjustment clamps generally indicated at 60.

Each of the respective leg panels is also formed with a leg panel hand hole 30 of substantially the same width dimension as the side panel hand holes 15 and are in vertical alignment therewith. As such, one may conveniently handle and move the portable laptop desk 10 by grasping the desk through the respective sets of hand holes 15 and 30.

The bottom of each of the respective leg panels 26 is formed with a respective inwardly curved and upturned resting pad 28 positioned below the bottom edge of each of the respective side panels 14. The curved resting pad better distributes the weight of the laptop desk and the articles supported thereon over a greater surface area preventing damage to the underlying surface on which the laptop desk rests. In addition, the configuration of the resting pads facilitate positioning of the laptop desk over the lap of a user and between the arm rests of a wheel chair without binding or hanging up on wheel chair side panels.

Adjustably mounted to the front panel 18 is a elongated rectangular thigh rest panel 34 having a pair of laterally spaced apart thigh rest vertical height adjustment slots 36. The thigh rest panel may be vertically adjusted to rest on a user's thighs. When the thigh rest panel is resting on a user's thighs, a portion of the weight of the laptop desk, and the articles supported thereon rests on the user's thighs, the user's thighs providing additional stability to the laptop desk. Similar to the leg panels 26, the thigh rest panel is adjustably mounted to the tray 12 and front panel by a pair of adjustment clamps 60. The front panel adjustment clamps may be a smaller scale version of the side panel adjustment clamps.

The desk work surface or article support surface 20 is pivotally mounted from its rearward opposite ends to the side panels 14 of the tray 12 by a pair of pivot pins 40. The support surface is generally rectangular and planar having, at the front end thereof, a downwardly curved nose portion 22. The rear edge of the support surface has an upwardly projecting article holding lip 24 along the lateral extent thereof. In addition, the bottom surface of the support surface 20 has a center support brace 25 (shown in phantom, FIG. 1) that provides increased structural integrity and stability to the laptop desk structure.

Referring now to FIGS. 2 and 3, at the opposite sides of the rear of the article support surface 20, the bottom surface thereof has a pair of pivot brackets 38 mounted thereon and from which the support surface is pivoted. The respective brackets mount the respective laterally outwardly projecting pivot pins 40 which pivot relative to the frame or tray 12.

With particular reference to FIG. 4, each respective pivot pin 40 has a generally cylindrical pivot pin shaft 50 having an enlarged screw head 48 on one end and a reduced-in-diameter threaded portion 52 on the other end. As shown, the pivot pin is threadedly engaged to the support surface bracket 38, the shaft 50 being slidably received within a pivot bore of the side panel 14. As such, the support surface 20 is rotatable with respect to the side panel and thus tilts upwardly relative to the tray 12 (see FIG. 3).

A rectangular tilt panel 41 is pivotally mounted at the bottom front edge thereof from tilt panel pivot pins 44 mounted on the respective inner surfaces of the top front of the side panels 14. As shown in FIG. 3, when the support surface 20 is tilted upwardly, the tilt panel may be pivoted upwardly and the top edge thereof located under the curved nose 22 of the support surface. In this position, the curved nose of support surface rests on the top edge of the tilt panel to hold the article support surface at approximately a 60° angle of inclination relative to horizontal. It is to be appreciated that the length of the tilt panel may be selectively varied at manufacture to provide different angles of titled inclination for the article support surface.

A pair of respective tilt panel blocks 46 are mounted to the respective inner top rear surfaces of the side panels 14 so that when the support surface 20 is in its non-elevated horizontal position as shown in FIG. 2, the tilt panel 42 rests on the respective blocks blocking further downward movement thereof to allow for open rearward access to the tray 12.

Referring now to FIGS. 5–8, the construction of the adjustment clamps 60 can be described in further detail. In general, the adjustment clamp includes a shaft 62, a Belleville spring washer 72, a compression cam 78, and a tightening member 88. The respective side panels 14 of the tray 12 and respective leg panels 26 are sandwiched between the Belleville spring 72 and compression cam 78, so that when a tightening member 88 is rotatably shifted, the camming action of the cam compresses the Belleville spring. The Belleville spring, in turn, compresses the leg and side panels together to frictionally lock the leg panel relative to the side panel at a selected adjustment height.

Figure 6:
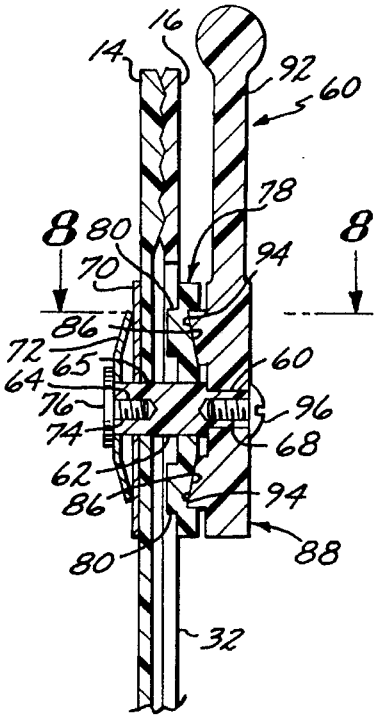
FIG. 6 is a sectional side view of the adjustment clamp taken along line 6—6 of FIG. 5.

With particular reference to FIG. 6, the adjustment clamp shaft 62 is cylindrical having first and second ends, the first end formed with a first axial threaded bore 64 therein. The second end of the shaft has a reduced-in-diameter cylindrical journal surface 68 and is formed with a second axial threaded bore 68 therein. As shown, the shaft is slidably received within a side panel bore 65 of the side panel 14 and within the adjustment slot 32 of the leg panel 16.

A first bolt 74 having an enlarged diameter head 76 is threadedly engaged within the first shaft bore 64. A flat washer 70 and the Belleville spring washer 72 are slidably disposed over the first end of the shaft 62 and interposed between the enlarged head 76 of the first bolt 74 and the inner surface of the side panel 14, the flat washer positioned adjacent the side panel.

A second bolt 96 having an enlarged diameter head is threadedly engaged within the second bore 68 of the shaft 62. The compression cam 78 and tightening member 88 are slidably disposed over the second end of the shaft 62 and interposed between the enlarged head of the second bolt 96 and the outer surface of the leg panel 16, the compression cam positioned adjacent the leg panel.

Figure 7:
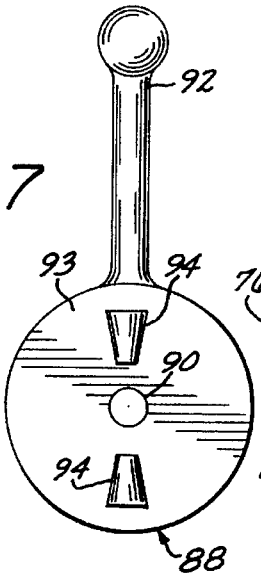
FIG. 7 is a back view of the tightening member shown in FIG. 5.

Referring now to FIGS. 5 and 7, the tightening member 88 is generally formed as a disk having a central bore 90 therethrough and an upwardly extending handle 92. The back face 93 of the tightening member is formed with a pair of outwardly projecting segmented frustoconical cam followers 94 (FIG. 7). The cam followers are spaced apart equidistantly and radially opposite from the central axis of the disk, and frustoconically diverge outwardly therefrom. The cam followers are in vertical alignment with the handle 92.

Figure 8:
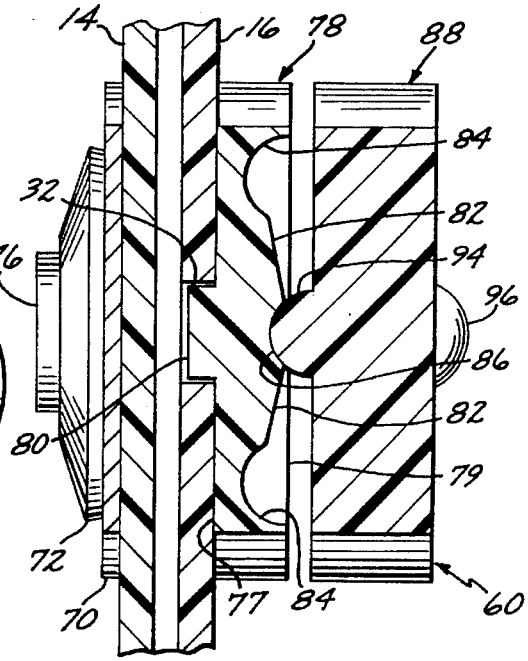
FIG. 8 is an enlarged sectional top view of the adjustment clamp taken along line 8—8 of FIG. 6.

With reference to FIGS. 6 and 8, the compression cam 78 is also generally in the form of a disk. The back face 77 of the cam is formed with a pair of vertically aligned outwardly projecting rectangular shaped guides 80. The guides are spaced apart equidistantly, and radially opposite, from the central axis of the cam. The width of the guides are narrower than the width of the adjustment slots 32 such that, when the adjustment clamp is not actuated, the guides freely slide vertically within the adjustment slot 32 of the leg panel 16.

Referring particularly to FIG. 8, the front face 79 of the compression cam 78 includes a plurality of dedents and camming surfaces. In the preferred embodiment, four "loosening" dedents 84, two upper and two lower, and two "tightening" dedents 86, one upper and one lower, are provided. As shown in FIG. 8, only two upper loosening dedents 84 and the one upper tightening dedent 86 are illustrated. All of the dedents are formed as longitudinally segmented frustoconical inward depressions, the tightening dedents 86 not as inwardly depressed into the front face of the compression cam as the loosening dedents 84. The two tightening dedents are spaced apart equidistantly, and radially opposite, from the central axis of the cam (FIG. 6). In addition, the tightening dedents frustoconically diverge radially outwardly and are in vertical alignment with the guides 80 on the back face 77 of the compression cam. The loosening and tightening dedents are formed dimensionally to conform substantially to the curvature of the outwardly projecting frustoconical compression cam followers 94.

The four loosening dedents are configured in two paired relationships, the respective upper two dedents 84 of each pair shown in FIG. 8. Each pair of loosening dedents is spaced apart equidistantly and radially opposite from the central axis of the compression cam 78. Similar to the tightening dedents, the loosening dedents frustoconically diverge radially outwardly from the central axis. Each respective pair of loosening dedents is aligned radially from the central axis and each pair is angularly offset from vertical. The respective pairs of loosening dedents are equidistantly offset angularly and opposite from one another 15° from the vertical axis of the cam.

The back face 77 of the compression cam 78 is formed with tapered angular camming surfaces 82, the radial dimensional width thereof being substantially the same longitudinal dimension as the frustoconical dedents, 84 and 86. Contemporaneously, the camming surfaces taper angularly and axially outwardly from the respective loosening dedents 84 toward each of the tightening dedents 86.

When the adjustment clamp is assembled, as shown in FIG. 6, the journal bearing surface 68 of the second end of the shaft 62 is slidably received within the bore 90 of the tightening member 88. As such, the tightening member is rotatable with respect to the shaft and compression cam 78. The back face 93 of the tightening member is in confronting relationship with the front face 79 of the compression cam 78 so that the cam followers 94 of the tightening member are disposed within the dedents 84, 86 or camming surfaces 82 of the compression cam.

To tighten an adjustment clamp 60, the tightening handle 92 is rotatably moved from one of the positions shown in phantom (FIG. 5) to vertical. As such, the cam followers 94 of the tightening member slide along the camming surfaces 82 of the compression cam 78 from a loosening dedent 84 to the tightening dedent 86 (FIG. 8). Referring to FIG. 6, as a result, the tightening member 88 confronts the enlarged head of the second bolt 96 so that the tightening member and the shaft 62 move axially outwardly relative to the compression cam. The shaft slidably moves within the bore of the side panel 14, the adjustment slot 32, and the bore of the compression cam. As such, enlarged head 76 of the first bolt engages the Belleville spring washer 72 compressing the Belleville washer against the flat washer 70. As this occurs, the flat washer presses against the side panel 14 and the face of the compression cam 78 presses against the leg panel 16 to frictionally lock the leg panel and side panel therebetween. When the handle is at its vertical position, as shown in FIG. 5, the cam followers 94 nest in the respective tightening dedents 86.

When the tightening handle 92 is rotatably moved off vertical to one of the positions shown in phantom (FIG. 5), the cam followers 94 of the tightening member 88 slide along the camming surfaces 82 of the compression cam 78 and rest in one of the loosening dedents 84. As such, the camming action between the adjustment clamp components is reversed from that which was described above. As a result, the Belleville washer 72 is uncompressed and relieves the compressive force between the side panel 14 and leg panel 16.

When the adjustment clamps are in this unactuated state, the respective leg panels 16 or the front thigh rest panel 34, as the case may be, can be individually adjusted vertically relative to the frame 12. As such, the guide pins 80 of the compression cam are free to slide vertically within the adjustment slots 32 of the respective leg panels 16 or within the thigh rest adjustment slots 36. The adjustment clamps can be actuated anywhere along the adjustment slots, thus providing for infinite adjustment resolution over the extent of such slots. The high resolution adjustment clamps can be used to comfortably fit the laptop desk to many different users and accommodate the many positions such users may orientate themselves in. In addition, this increased resolution provides for fine adjustment of the laptop desk 10 over the user's lap for increased comfort and utility.

It is to be appreciated that the construction and design of the adjustment clamp 60 allows for the elderly, handicapped, infirm, or those otherwise lacking manual dexterity, to adjust the laptop desk 10 over their lap to their liking and comfort. The design of the clamps requires minimal angular rotation (15 degrees) of the tightening member 88 and minimal torsional force be exerted on the tightening handle 92 for releasing and locking the legs 16 and thigh panel 34 relative to the laptop desk tray or frame 12. The adjustment clamps are easy to access, and when the laptop desk has been adjusted over the user's lap, the clamps provide secure locking engagement of the leg panels and/or thigh rest relative to the desk without the use of tools.

Once the laptop desk 10 has been adjusted over the user, the user may desire to tilt back the article support surface 20 for reading. With reference to FIGS. 2 and 3, to tilt the article support surface, the user simply grasps the front edge of the support surface under the curved nose 22 and pulls the surface upwardly to pivot the surface about the rear pivot pins 40. The user then, with the article support surface held in this upward position, grasps the tilt panel 42 and tilts it upwardly to pivot about the front tilt panel pivot pins 44. The tilt panel 42 is tilted to an inclination so that the underside of the curved nose 22 of the article support surface may rest on the top edge of the tilt panel. The curved nose and the upper edge of the tilt panel cooperate to securely hold the article support surface at its tilted inclination. The article holding lip 24 holds articles on the support surface for convenient viewing.

The leg 16, side 14, front 18, and tray 16 panels are preferably composed of a acrylonitrile-butadiene-styrene (ABS) plastic, and are formed by injection molding. The pivot brackets 38 and article support surface 20 are composed of acrylic plastic, the pivot brackets being injection molded and the support surface formed by thermoforming. The tightening member 92 and tilt panel 42 are composed of "DELRIN" by Dupont, an acetal resin thermoplastic, and formed by injection molding.

All of the aforementioned components are of a thickness which is sturdy and structurally sound for purposes of regular anticipated laptop desk use. As such, the materials of construction and the selected dimensions and thicknesses thereof provide a lightweight, and therefore easily portable, laptop desk. In addition, the primary components of the laptop desk are formed of readily available and relatively inexpensive materials in which the cost effectiveness may be passed on to the consumer.

It is to be appreciated that different materials of construction may be utilized for different environments and applications. For instance, lightweight aluminum or stainless steel may be used rather than plastic in certain hospital applications. These other materials of construction may be more easily cleaned and more sanitary under some conditions.

Furthermore, the laptop desk has been sized so that it may be used in automobiles and wheelchairs. As such, the laptop desk is laterally narrow enough to fit between the arms of a conventional wheelchair, and small enough for convenient use in automobiles.

From the foregoing, it will be appreciated that the laptop desk of the invention provides an adjustable height article support surface having a storage tray thereunder, and a means to tilt the support surface from horizontal to a comfortable reading inclination.

While a particular form of the invention, has been illustrated and described, it will be apparent that various modifications can be made without departing from the spirit and scope of the invention.

What is claimed is:

1. The combination of a portable laptop desk and a bed, chair or the like having an underlying surface, such combination comprising:

a laptop desk frame having a lateral support member which includes a bottom panel, an upstanding front panel fixedly attached to the front edge of the bottom panel and two upstanding side panels fixedly attached to said bottom panel on the lateral opposite ends thereof to form a tray;

a pair of support legs vertically adjustably secured to said side panels with the lower ends of the legs resting upon said underlying surface;

releasable adjustment means interconnecting the upstanding side panels and the legs to hold said legs at a selected vertical spacing relative to said frame and said underlying surface;

a planar article support surface having a forward and rearward edge, said rearward edge being hingedly attached to the lateral support member of said frame so that said article support surface may be tilted relative to said frame;

a tilt arm pivotally mounted to said frame so that when said article support surface is tilted, said tilt arm is engageable with said support surface to hold said support surface at a selected inclination relative to said frame; and, a thigh rest panel vertically adjustably mounted to the front panel of said frame independent of the vertical adjustment of said legs relative to said frame.

2. The combination of claim 1, wherein the rearward edge of the article support surface includes an upstanding lip for holding articles thereon when said support surface is tilted.

3. The combination of claim 1, whereto the releasable adjustment means are clamps which include;

a shaft having first and second ends;

a compression spring disposed on said shaft at said first end;

a clamping device slidably disposed on said shaft having an engagement surface on one side and a camming surface on the other side; and a tightening member attached to said shaft at said second end having a plurality of cam followers thereon and a handle wherein when said handle is turned said cam followers follow said camming surface to compress said compression spring to press said clamping device against said legs to frictionally lock said legs relative to said frame.

4. The combination of claim 3, wherein the rearward edge of the article support member includes a lip for holding articles thereon when said support surface is tilted.

* * * * *